United States Patent [19]

Javeri

[11] 4,380,980

[45] Apr. 26, 1983

[54] IGNITION SPARK TIMING CIRCUIT

[75] Inventor: Rupin J. Javeri, Elk Grove, Ill.

[73] Assignee: Motorola Inc., Schaumburg, Ill.

[21] Appl. No.: 310,029

[22] Filed: Oct. 13, 1981

[51] Int. Cl.[3] ..... F02P 7/00

[52] U.S. Cl. ..... 123/414; 123/609; 123/643

[58] Field of Search ..... 123/414, 416, 609, 610, 123/611, 643

[56] References Cited

U.S. PATENT DOCUMENTS

| | | | |
|---|---|---|---|
| 4,313,414 | 2/1982 | Planteline | 123/414 X |
| 4,329,959 | 5/1982 | Javeri | 123/416 |
| 4,338,903 | 7/1982 | Bolinger | 123/414 X |
| 4,352,345 | 10/1982 | Menard et al. | 123/416 X |

FOREIGN PATENT DOCUMENTS

| | | | |
|---|---|---|---|
| 55-104568 | 8/1980 | Japan | 123/643 |

*Primary Examiner*—Tony M. Argenbright
*Attorney, Agent, or Firm*—Margaret Marsh Parker; James S. Pristelski; James W. Gillman

[57] ABSTRACT

The circuit determines which cylinder is to be fired and continually updates the determination so that the circuit recovers immediately from any false detect and responds to any change of engine condition. The dwell timing is derived from sensors adjacent the flywheel and, to achieve the widest possible range of advance angles, the use of certain sensor-derived signals is delayed until after spark.

8 Claims, 5 Drawing Figures

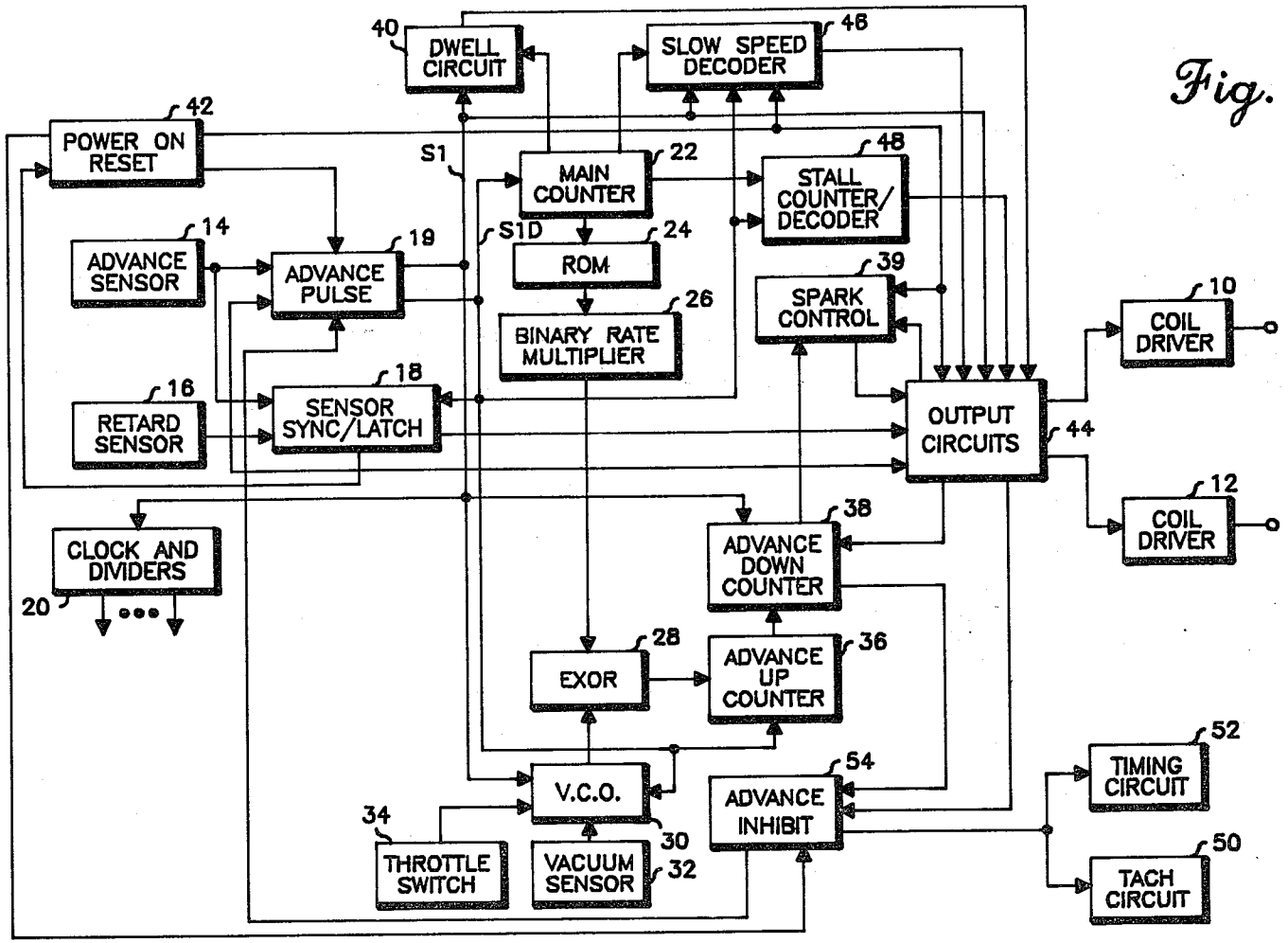
Fig. 1
COIL DRIVER
10
COIL DRIVER
12
TIMING CIRCUIT
52
TACH CIRCUIT
50
OUTPUT CIRCUITS
44
SLOW SPEED DECODER
46
STALL COUNTER/ DECODER
48
SPARK CONTROL
39
ADVANCE DOWN COUNTER
38
ADVANCE UP COUNTER
36
ADVANCE INHIBIT
54
MAIN COUNTER
22
ROM
24
BINARY RATE MULTIPLIER
26
EXOR
28
V.C.O.
30
VACUUM SENSOR
32
THROTTLE SWITCH
34
DWELL CIRCUIT
40
S1D
S1
ADVANCE PULSE
19
SENSOR SYNC/LATCH
18
POWER ON RESET
42
ADVANCE SENSOR
14
RETARD SENSOR
16
CLOCK AND DIVIDERS
20

IGNITION SPARK TIMING CIRCUIT

CROSS REFERENCE TO RELATED APPLICATIONS

The present invention is related to the inventions described and claimed in copending U.S. patent applications, Ser. Nos. 310,004 and 310,028, filed as of even date with the present Application. Both of these copending U.S. Applications are assigned to the same assignee as is the present invention.

BACKGROUND OF THE INVENTION

This invention relates to the field of distributorless electronic ignition systems and, more particularly, to the accurate determination of the proper cylinder to be fired at each spark pulse.

With the transition from mechanical devices for coupling an ignition coil to the spark plugs of an internal combustion engine to electronic (distributorless) circuits has come the problem of identifying the crankshaft position and being certain that the proper cylinder or cylinders are fired at each spark pulse. It is also desirable to continually update the position information. It is also important to provide the widest possible range of spark advance in such a system.

Many different combinations of sensors with sensible or detectable elements on the crankshaft or flywheel of an internal combustion engine have been utilized for the purpose of determining crankshaft position and speed of rotation. One such arrangement has utilized three tabs or projections on the flywheel, two being spaced 180° apart and the third spaced 72° ahead of one of those two. Two sensors are spaced adjacent the flywheel edge and 72° apart. It is then apparent that each sensor will output three pulses per revolution, and that only once per revolution will there be simultaneous output pulses. While these sensor outputs could be used in many ways, it is apparent that the two simultaneous or "synchronized" pulses could be used to indicate the correct cylinder to be fired. However, if a very wide range of advance angles is desired, it may be difficult to use the sync pulses for this purpose; e.g. the desired spark time may be later than the sync pulse occurrence.

SUMMARY OF THE INVENTION

It is, therefore, an object of the present invention to provide a highly accurate cylinder detection circuit.

It is another object to allow the widest possible range of spark advance angles.

It is an additional object to provide constant updating of the cylinder detect information.

These objects and others which will become apparent are obtained in a logic circuit wherein, at a slow speed, the cylinder detect signal is derived directly from the sensor pulses and, at normal running speeds, spark timing is determined by a continuous calculation within the system. In both of these cases, the dwell ends at or before the synchronous pulse derived from the two simultaneous sensor pulses. In a third instance, at engine velocities higher than the above described slow speed, a very long dwell may be desirable with spark occurring after TDC. This is possible if the use of the sync signal is delayed until spark occurs.

BRIEF DESCRIPTION OF THE DRAWING

FIG. 1 is a block diagram of the overall system including the invention.

DETAILED DESCRIPTION OF A PREFERRED EMBODIMENT

The block diagram of FIG. 1 illustrates a four cylinder automobile ignition system which includes one embodiment of the present invention. The system is an electronic advance (distributorless) system which is well suited to integrated circuit implementation. The invention is, however, not to be construed as limited to this particular system or to IC implementation but, rather, may be more easily understood in this environment.

As may be seen, two coil driver circuits 10, 12 are shown, each for energizing one coil, each coil supplying a spark to two cylinders (not shown), one during its power stroke and one during its exhaust stroke.

Figure 2A:
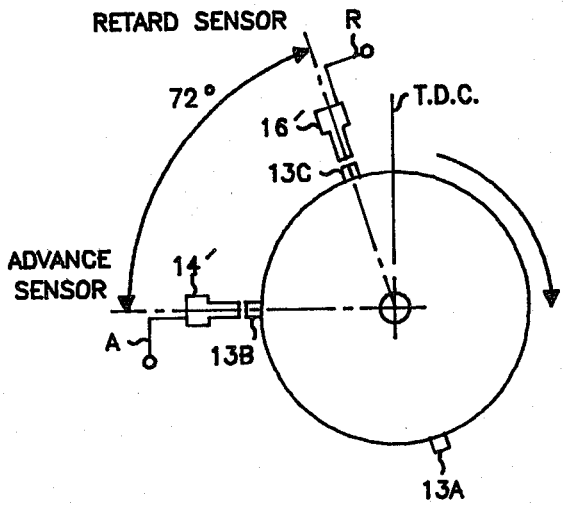
FIG. 2A is a diagram illustrating the positioning of the engine speed sensors and the tabs on the crankshaft.
Figure 2B:
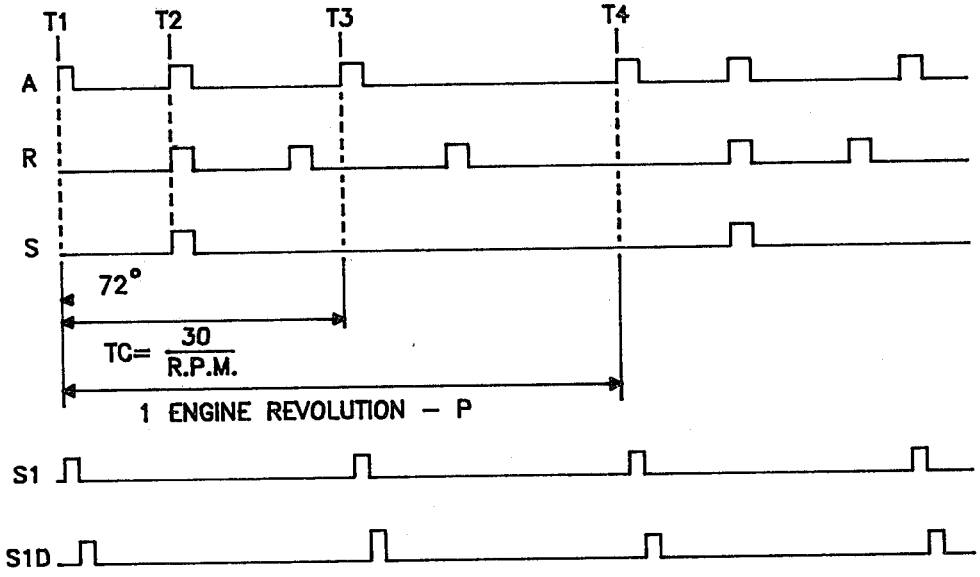
FIG. 2B is a timing diagram relating to the diagram of FIG. 2A.

In FIG. 2A there are three projections 13*a*, 13*b*, 13*c* on a flywheel 13 of an engine (engine not shown). The projections are sensed by two proximity (Eddy current) sensors 14', 16' which are part of an "advance" sensor circuit 14 and a "retard" sensor circuit 16 respectively, as seen in FIG. 1. From FIG. 2A it can be seen that only once per crankshaft revolution (at T2 of FIG. 2B) will there be simultaneous pulses from the two sensors. This allows for a relatively exact determination of engine (crankshaft) position. FIG. 2B is a timing chart showing the pulses derived from the advance (A) and retard (R) sensors. From the three output pulses per cycle from each of these sensors, a synchronizing pulse (S) is obtained by a sensor synchronizing pulse circuit 18. The synchronizing pulse is used to determine which coil driver is to be enabled.

Returning now to FIG. 1, an advance pulse circuit 19 provides an advance pulse (S1) in response to the leading edge of one of the advance sensor pulses (see FIG. 4) and also provides a one-clock-pulse delay for the advance signal. The S1 pulse begins at the next clock pulse after the leading edge of the A pulse, and is one clock pulse wide. The delayed signal (S1D) is also used extensively for timing in the circuit. A clock and associated dividers 20 provide a number of clock signals which are used in the various counter circuits described hereinafter. A main counter 22 counts clock pulses between each two S1 pulses, thus the maximum count depends on engine speed. The counter 22 outputs are coupled to a ROM 24 and each count constitutes an address, thus the number of addresses explored between S1 pulses depends on engine speed. The data stored at each address in the ROM is a function of engine speed, the ROM having been programmed to provide the desired advance curve with respect to speed. The ROM output data is coupled to a binary rate multiplier (BRM) 26 which is also coupled to the clock/dividers 20. The BRM is coupled to one input of an EXOR 28. A voltage controlled oscillator (VCO) 30 is controlled by inputs from a vacuum (manifold pressure) sensor 32 and (optionally) a throttle switch 34. The VCO output is coupled to a second input of the EXOR 28, which then performs an adder function on the two sets of input pulses. That is, unless two pulses have exactly coincidental leading or trailing edges, each EXOR input pulse will be represented by one output pulse. The output of the EXOR 28 is coupled to an advance upcounter 36 which increments from one S1D pulse to the next. The count in the advance upcounter 36 is transferred to an advance downcounter 38 once during each cycle but, since the downcounter 38 is clocked at a higher rate than the upcounter 36, the count down requires less time then the count up. At the end of the advance count down, a spark control circuit 39 may initiate the spark for the appropriate cylinders.

Since the dwell time must be controlled for all engine speeds, it is necessary to, in effect, "count back" from the required spark time in order to determine the correct dwell time beginning. This is done by a dwell counter 40 which also receives the maximum count from the main counter. The count in the dwell counter is rapidly decremented a fixed number of counts, then held until spark time occurs, then decremented at the same rate as the main counter. Dwell begins at the zero count of the dwell counter.

A power-on-reset circuit (POR) 42 prevents any cylinder from being fired initially until the sensor synchronizing pulse circuit 18 has determined the crankshaft position, thus preventing the wrong cylinder from being fired. Gating circuits in output circuits 44 process the spark control signals being coupled to the coil drivers 10, and 12. A slow speed decoder 46 detects any overflow of the main counter 22 (which indicates a low speed condition) and forces the spark to occur with no advance angle. A counter in a stall decoder 48 also receives the main counter overflow and when the stall decoder counter overflows (indicating the engine speed is going into a "stall" condition), primary coil current is slowly decreased to zero and the whole system is shut down. A signal from an advance inhibit circuit 54 inhibits any advance pulses during the spark period and can also be coupled to a tachometer circuit 50 or any other timing circuit 52 requiring a direct correlation with engine speed, such as a control for fuel injection.

Figure 3:
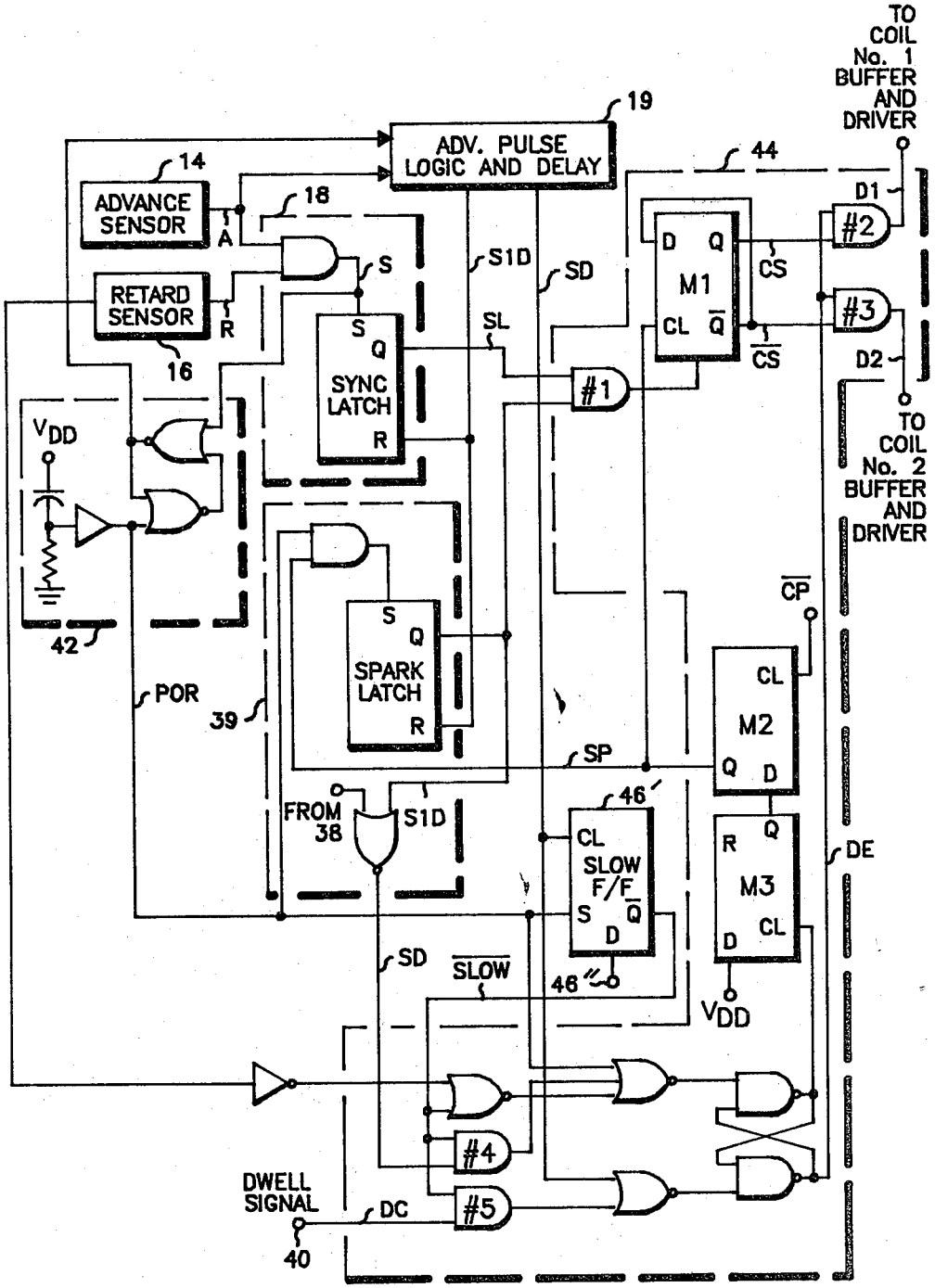
FIG. 3 is a block/logic diagram of one embodiment of the invention.
Figure 4:
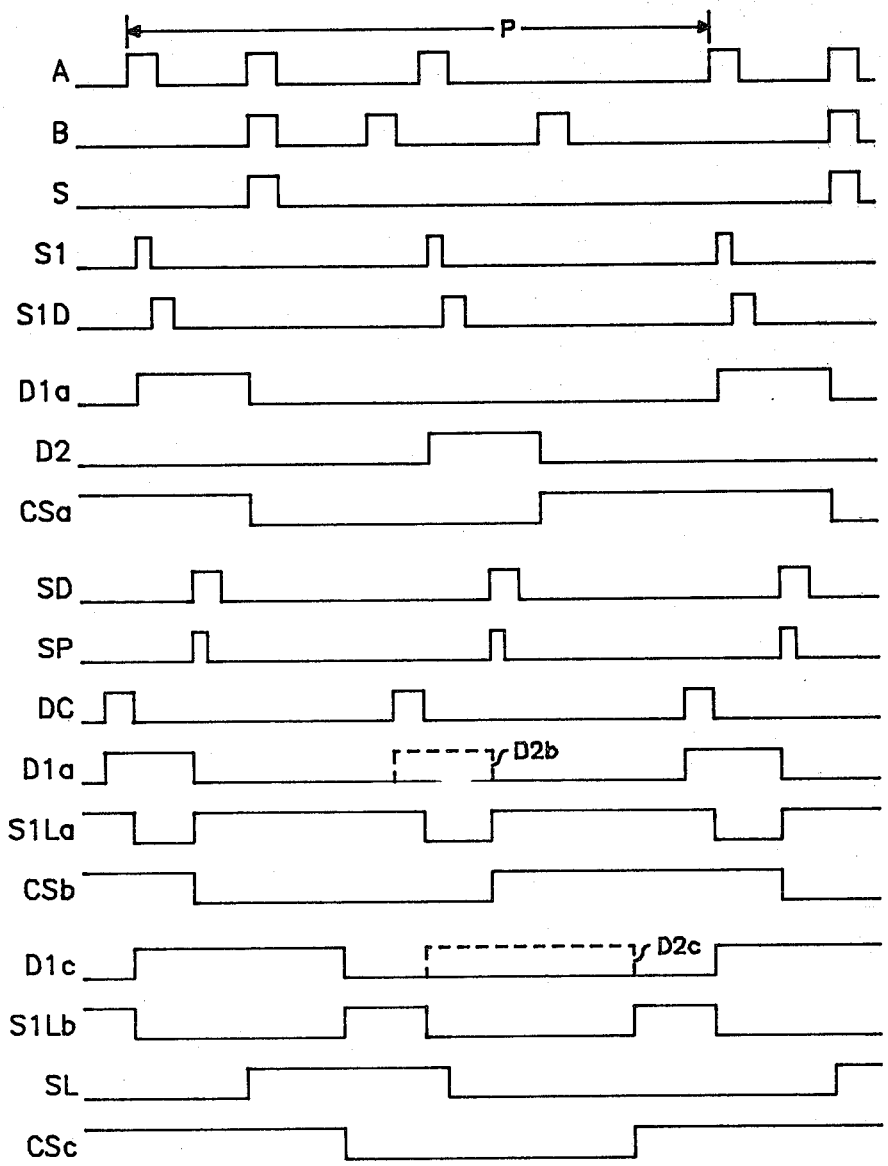
FIG. 4 is a timing diagram relating to the diagram of FIG. 3.

FIGS. 3 and 4 will be considered together, FIG. 4 being the timing diagram for the circuit of FIG. 3. The operation of the standard logic elements will not be described in detail. The first three lines of FIG. 4 duplicate the diagram of FIG. 2B and are included here for easier reference to the remainder of the signal. The interval P designates one rotation period of the crankshaft. Signal A has three pulses per crankshaft revolution, representing the three projections 13*a*, 13*b*, 13*c* on the flywheel as detected by the "advance" sensor. Signal R from the "retard" sensor has the same pulses, lagging Signal A by 72°, the spacing of the advance and retard sensors 14', 16'. Signal S ("sync" pulse signal) has one pulse per crankshaft revolution, and is due to the coincidence of one pair of pulses in A and R. Signal S is the output of an AND gate in the sensor synchronizing circuit 18, and is the "set" signal for the latch in circuit 18. The latch output (signal SL) is one input signal for the AND gate #1 in the output circuits 44.

Signal S1 is derived from the first pulse of signal A with other enabling signals as described above. S1D is the S1 signal as delayed by a flip-flop in the advance pulse logic and delay 19. The next two lines of FIG. 4 are signals D1*a* and D2 which represent the complementary dwell timing signals from NAND gates #2 and #3 in the output circuit 44, which would be coupled through buffer circuits to the coil driver circuits 10, 12, respectively, when a "slow speed" detect signal is being provided by the slow speed decoder 46 of FIG. 1. Since, at slow speeds, it is desirable to eliminate the advance calculation, the dwell time for each coil is initiated by an S1 pulse and is ended by a pulse of the retard sensor signal R. This is made possible by the slow signal from slow speed decoder 46 which prevents the dwell signal DC and the spark decode signal SD from passing through the AND gates #4 and #5. It is to be noted that, in the preferred embodiment, the slow speed decoder 46 would include in addition to the F/F 46' shown in FIG. 3, a latch 46'' (shown only as the input D of F/F 46'). The latch 46'' latches a slow detect signal which is derived from the count in the main counter 22. Thus the dwell enabling signal DE is, under slow speed conditions, controlled only by S1 and R pulses. Thus, as may be seen in FIG. 2A, the spark occurs at the R pulse which would be, typically, at 10°bTDC. Signal CSa is the cylinder select signal for this condition and enables the D1*a* and D2 outputs alternately. Signals CS and CS are outputs of the F/F #1 in output circuits 44.

The next 6 timing signals in FIG. 4 represent the normal or "calculated" mode of operation. The SD or "spark decode" signal comes from the spark control circuit 39 and is enabled when the advance downcounter 38 reaches zero. The SD signal ends the dwell time. The SP signal is a spark enabling signal and is one output signal from the output circuits 44; specifically, the Q output from the F/F M2. The DC signal is the output signal from the dwell counter 40, and for the normal operating range initiates dwell. Thus the DE signal is now controlled by the SD and DC signals. The dwell counter 40 includes the counter proper which, as described above with respect to FIG. 1, derives its initial count from the main counter 22 and, at zero count, initiates dwell through a latch in the dwell circuit 40 which is reset by the S1 signal. The D1*b* signal is an exemplary calculated dwell time under normal speed conditions. In this instance, the corresponding signal D2*b* is not shown separately but the pulses of D2*b* would lie between the pulses of D1*b* as indicated by one dotted-in pulse. The S1La signal is the output of the latch in the spark control circuit 39 and is derived from S1D. As may be seen, while the "slow" signal is high, the SD and DC signals can put a high on the NAND gates #4 and #6, respectively, so that the dwell signal DC can initiate dwell and the spark decode signal SD can terminate dwell. Signal CSb indicates the ignition coil switching at the output of F/F M1.

The last four lines of FIG. 4 represent an important set of conditions; namely, engine speed just higher than would cause a "slow" indication, where the spark is desired to occur after the sync pulse S. In this "retarded spark" case, the use of the sync pulse S is delayed until after the spark occurs. In this instance the SL signal, which was derived from the S signal and is applied to one input of the AND gate #1, is not applied to the reset of M1 in output circuit 44 until the SP signal from M2 sets the latch in the spark control 39. Thus, the signal CSc changes polarity at the end of the dwell time of signal D1*c* (and of D2*c*). The significance of this last set of conditions is that it provides an extra range of advance angles that is not normally available, particularly in an electronic ignition system of this type.

As may be seen from signals D1*a*, D1*b*, D1*c*, the end of dwell, or spark time, can occur over a wide range of advance angles using a relatively simple sensor arrangement. Other variations and modifications of the invention are possible and it is desired to cover all such as fall within the spirit and scope of the appended claims.

What is claimed is:

1. An ignition spark timing circuit comprising:

first circuit means for providing first and second control signals, each in response to engine crankshaft rotation;

second circuit means for providing a spark enabling signal;

third circuit means for providing a switching signal having two values in response to crankshaft velocity being above or below a predetermined velocity;

fourth circuit means including latching means coupled to be set by the spark enabling signal and reset by the first control signal delayed, and providing a spark detect output signal;

fifth circuit means for providing a dwell control signal; and sixth circuit means for providing a dwell enabling signal, the sixth circuit means controlled by the switching signal to enable dwell in response to the first control signal and to disenable dwell in response to the second control signal at engine velocities below the predetermined velocity, and to enable dwell in response to the dwell control signal and disenable dwell in response to the spark detect signal at velocities higher than the predetermined velocity.

2. An ignition spark timing circuit according to claim 1 and wherein the first circuit means includes sensors for providing output pulses in response to the proximity of portions of an engine crankshaft as the crankshaft rotates.

3. An ignition spark timing circuit according to claim 1 and wherein the second circuit means includes a second latching means clocked by the dwell enabling signal inverted, and a third latching means coupled to receive the output of the second latching means, and the output signal of the third latching means is the spark enabling signal.

4. An ignition spark timing circuit according to claim 1 and wherein the timing circuit includes first counter means for counting clock pulses per engine crankshaft revolution and the third circuit means includes means coupled to the first counter means outputs and wherein the switching signal changes values in response to a predetermined count of the first counter means.

5. An ignition spark timing circuit according to claim 1 and wherein the timing circuit includes first counter means for counting clock pulses per engine crankshaft revolution and the fifth circuit means includes second counter means coupled to receive the maximum count of the first counter means, decrementing said maximum count by fixed number of counts, holding the decremented count until spark occurs, decrementing to zero, and wherein the dwell control signal is provided at the zero count of the second counter means.

6. An ignition spark timing circuit having multiple outputs and receiving signals related to engine crankshaft rotation, the circuit comprising:

first circuit means for providing a control signal and a synchronizing signal in response to the received signals;

second circuit means for providing a dwell control signal in response to at least one engine condition;

third circuit means coupled to the second circuit means for providing a spark enabling signal;

fourth circuit means for sequentially switching the dwell control signal to ones of the multiple outputs; and fifth circuit means coupled to the first circuit means, the third circuit means and the fourth circuit means, for latching the synchronizing signal and gating said signal to the fourth circuit means in response to at least one signal relating to the spark enabling signal.

7. An ignition spark timing circuit according to claim 6 wherein the fifth circuit means includes a first latching means coupled to be set by the synchronizing signal and reset by one of the received signals.

8. An ignition spark timing circuit according to claim 6 wherein the fifth circuit means includes latching means coupled to be set by the spark enabling signal and reset by one of the received signals.

* * * * *